United States Patent [19]

Jordan et al.

[11] Patent Number: 5,040,619

[45] Date of Patent: Aug. 20, 1991

[54] WIRELINE SUPPORTED PERFORATING GUN ENABLING ORIENTED PERFORATIONS

[75] Inventors: John W. Jordan; Gregory N. Gilbert; Martin L. Tomek, all of Houston; Larry L. Grigar, East Bernard; Terry L. Slagle, Keller, all of Tex.

[73] Assignee: Halliburton Logging Services, Inc., Houston, Tex.

[21] Appl. No.: 508,749

[22] Filed: Apr. 12, 1990

[51] Int. Cl.[5] ..... E21B 43/116; E21B 23/00

[52] U.S. Cl. ..... 175/4.51; 166/50; 166/55.1; 166/241

[58] Field of Search ..... 175/4.51; 166/50, 55, 166/55.1, 241, 255, 297

[56] References Cited

U.S. PATENT DOCUMENTS

| | | | |
|---|---|---|---|
| 3,209,828 | 10/1965 | Lebourg | 175/4.51 |
| 4,194,577 | 3/1980 | Vann | 175/4.51 |
| 4,410,051 | 10/1983 | Daniel et al. | 166/55.1 X |
| 4,438,810 | 3/1984 | Wilkinson | 166/55.1 X |
| 4,637,478 | 1/1987 | George | 175/4.51 |

*Primary Examiner*—Hoang C. Dang
*Attorney, Agent, or Firm*—William J. Beard

[57] ABSTRACT

A perforating gun assembly is set forth. It incorporates a swivel connected with a cable head assembly and a navigation system for determining the instantaneous angle of the tool with respect to a vertical reference. There are first and second spaced cages formed of sleeves supported on bearing assemblies. The sleeves support free wheeling rollers which engage the casing when the tool is in the slant hole region of the well. There is an eccentric which falls downwardly, i.e., pointing toward gravity, and thereby defines a vertical reference and hence a horizontal reference. This eccentric mounts an elongate tubular housing for the shaped charges. Initially, the angle of firing of the shaped charges is adjusted at the time of installation with respect to the horizon and that in turn is correlated to the formation of interest in the well borehole which is then perforated with perforations which are parallel to the formation bedding plane.

6 Claims, 3 Drawing Sheets

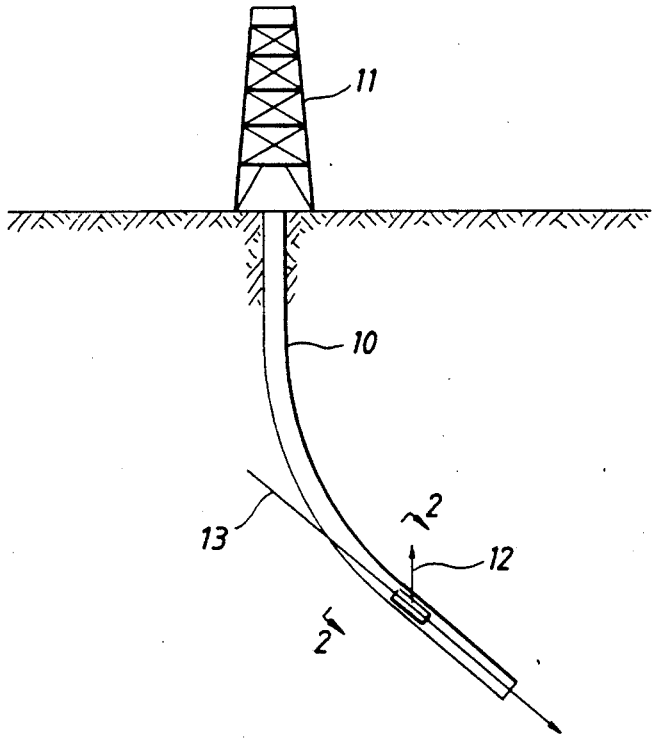
FIG. 1
FIG. 2
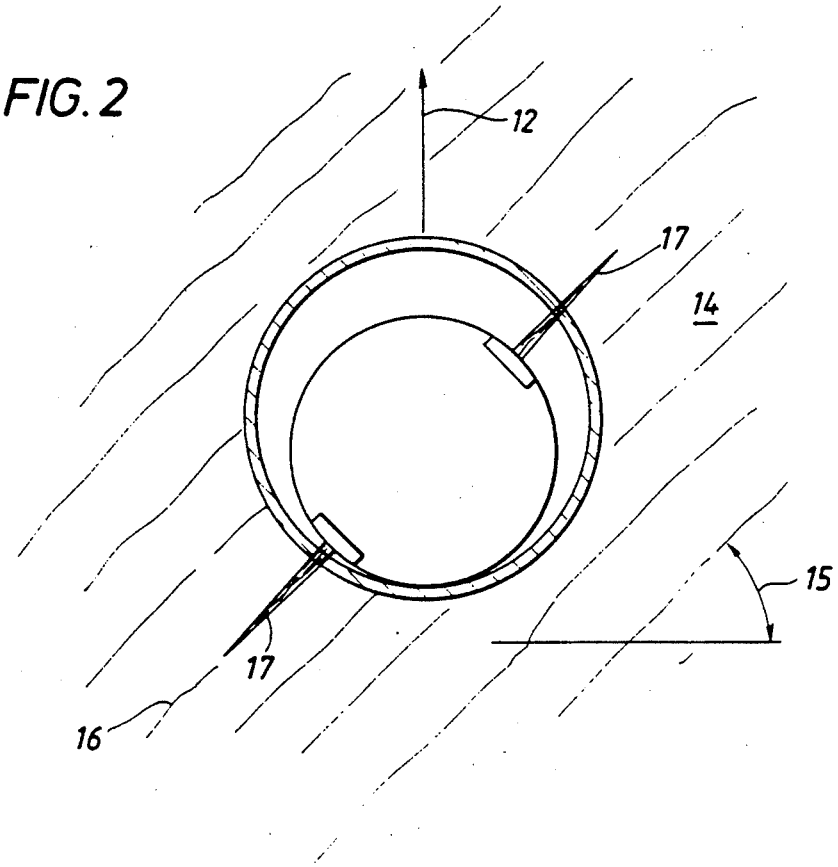

WIRELINE SUPPORTED PERFORATING GUN ENABLING ORIENTED PERFORATIONS

BACKGROUND OF THE DISCLOSURE

The present disclosure is directed to a wireline supported perforating mechanism, and more particularly to a perforating gun. It is intended for use in a slant well. It is especially intended to line up the perforations with a particular orientation relative to the formation which is tranversed by the slant well.

It is not uncommon to drill slant wells, especially from offshore platforms and the like. For instance, once a producing field has been discovered, one of the next steps is to install a platform at a proper location in the field. The platform may support the well head equipment for numerous wells, perhaps as many as sixty-four. Needless to say, while all sixty-four wells may come together at the platform, they terminate at multiple locations across the formation of interest. This involves the drilling of slant wells from the platform. Several slant wells are drilled in which a substantial portion of the well is inclined from the vertical. It is not uncommon to have an inclination as much as fifty, sixty or even seventy degrees deviation from the vertical. The present apparatus is particularly adapted for perforating on the slant where the perforating apparatus to be described is operated. There is another factor which creates a severe handicap to flow from the perforations. This relates to the direction of the formation which is traversed by the slant well. The well will pass through many formations. In the simplest of cases, the well is assumed to be vertical, and the formations are assumed to be parallel planes arranged horizontally with respect to the well and which are intersected perpendicularly. However, many formations which provide greater production include those which are arranged at different angles as a result of various geological events. In particular, the formations can slope upwardly or downwardly with respect to a horizontal reference plane. They might be as much as forty, fifty or even sixty degrees inclined from the horizontal reference. Moreover, formations have a type of grain which extends through them. This is sometimes known as the formation bedding plane or the fracture plane. These are planes which are found within the formation and which define a preference for production fluid flow. In fact, the preference can be so strong the one can think of the formation as having a grain in the same sense as wood. Heretofore, it has been impossible to lower a perforating gun on a wireline to a particular formation and operate that perforating gun so that perforations are accurately positioned at an angle where the perforations are parallel to the bedding plane of the formation. In other words, there has been no known approach for positioning the perforations so that they extend along the grain of the formation with surface, real time verification of position. The present disclosure sets forth a method and apparatus for accomplishing this.

This disclosure is directed to a wireline tool which can be lowered into a well borehole, typically a cased well, and can be lowered even into the slant portion. It is lowered to a depth sufficient to locate the perforating gun assembly opposite the formation of interest. The present apparatus further includes means functioning in the fashion of a pendulum which seeks the vertical gravity vector thereby defining a horizontal reference plane and further includes means permitting the perforating gun to be aligned with respect to the formation so that perforations are formed in the desired manner. In other words, the perforations are formed at the requisite well depth in the formation of interest, and the perforations extend parallel to the grain of the formation to thereby enhance production. This enables that type of orientation to be achieved.

The present tool is summarized as a wireline tool which is supported on a wireline cooperative with a casing collar locator and navigation apparatus. There is an elongate cylindrical sleeve gun tape which supports one or more shaped charges for forming perforations. That is connected with an eccentric which defines a weight at an adjustable angular position. All of the foregoing is able to rotate between upper and lower cradle assemblies which are equipped with rollers on sleeve line rotors. This allows the weight to fall to the low side as the tool is positioned in the slant well, which operates in the fashion of a plumb bob to seek the vertical. Appropriate perforating gun firing circuitry and other equipment is also included. More will be noted regarding the details of the structure hereinafter.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments therof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 of the drawings shows a slant well of the sort in which the present apparatus is used;

FIG. 2 is a cross-sectional view through the deviated well of FIG. 1 taken along the line 2—2 of FIG. 1 which view looks downhole to observe the tool in the cased well and further showing a formation intercepted by the slant well where the grain of the formation is at some angle.

DETAILED DESCRIPTION OF THE PREFERRED EMBODIMENT

Figure 3A:
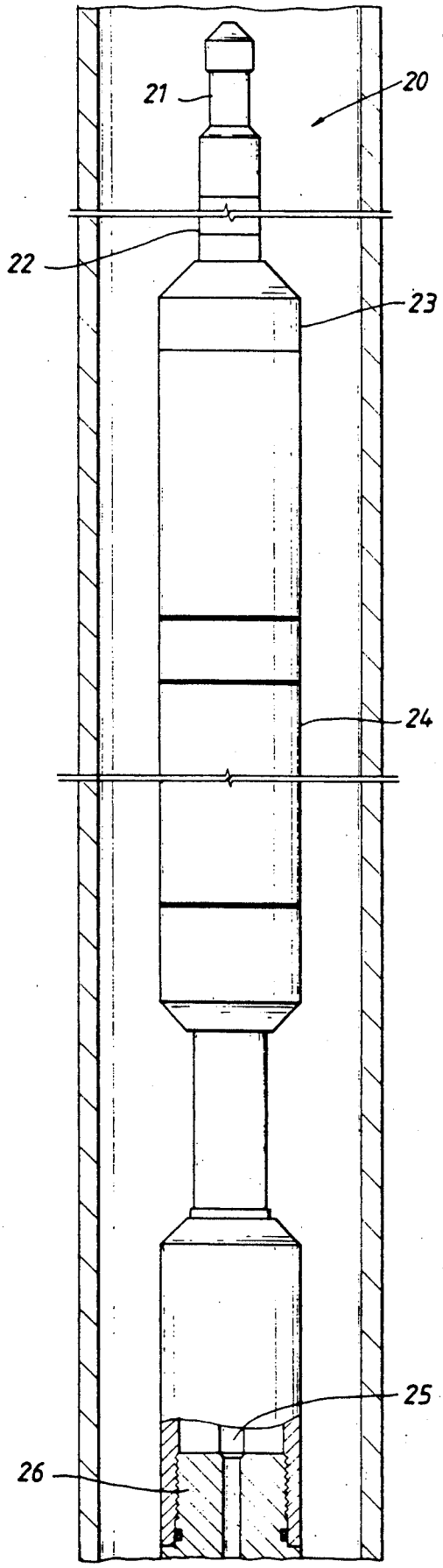
FIGS. 3A-3D show the elongate perforating gun assembly of the present disclosure.

Attention is directed to FIG. 1 of the drawings. In FIG. 1 a deviated well 10 extends from a drilling rig 11 which is at the surface, either on land or at sea. The deviated well 10 extends at some angle meaning that it deviates from the vertical. A vertical reference direction is indicated by the arrow 12. The direction of the well in that region is indicated by the arrow 13. The angle between the lines 12 and 13 is the angle of deviation. It can be as much as seventy degrees or so. Typically, at this stage of proceedings, the well is cased and the casing is cemented in place. Locations along the cased well can be determined by utilizing a casing collar locator (CCL) so that a formation of interest can be located. The formation of interest is indicated generally by the numeral 14 in FIG. 2 of the drawings.

The formation 14 extends at an angle 15 with respect to the horizontal reference line shown in FIG. 2 of the drawings. The vertical reference 12 again is reproduced in FIG. 2. Thus, the vertical reference 12 defines the horizon which serves as a reference. It is important to note that the formation 14 includes formation bedding planes 16 which extend with the formation. These define what is, loosely speaking, formation grain. The formation grain makes it highly desirable that perforations are formed parallel to the bedding plane 16. It is generally desirable that the perforations formed be precisely parallel. Obviously, this type of precision is not essential but it is highly desirable that the perforations extend approximately or close to the bedding plane angle. The perforations 17 shown in FIG. 2 are almost parallel to the formation bedding plane. This enables the perforations to take advantage of the natural flow channels found in the formation so that production is enhanced. As will be further understood, FIG. 2 is taken through the formation and only two perforations are shown, one extending up in the formation and the other extending downwardly in the formation. It is desirable that multiple formations be formed parallel to the perforations 17 shown in FIG. 2. They will all collectively be parallel to each other and hence or ideally parallel to the beding plane 16 of the formation 14.

Figure 3B:
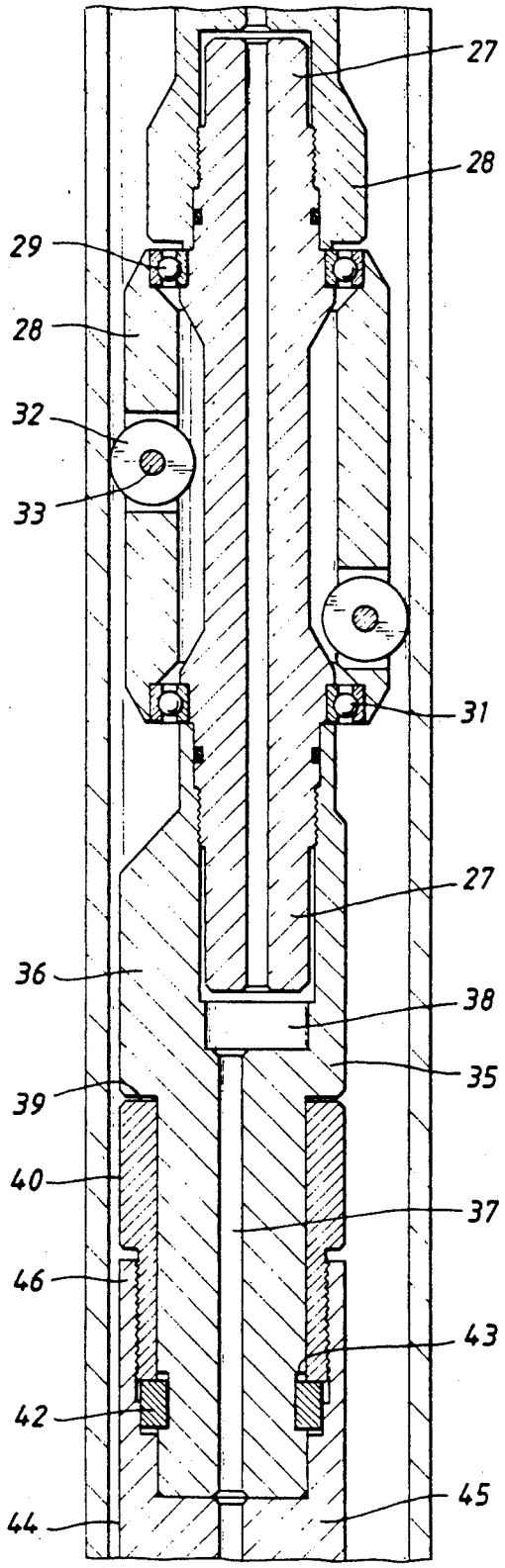
Figure 3C:
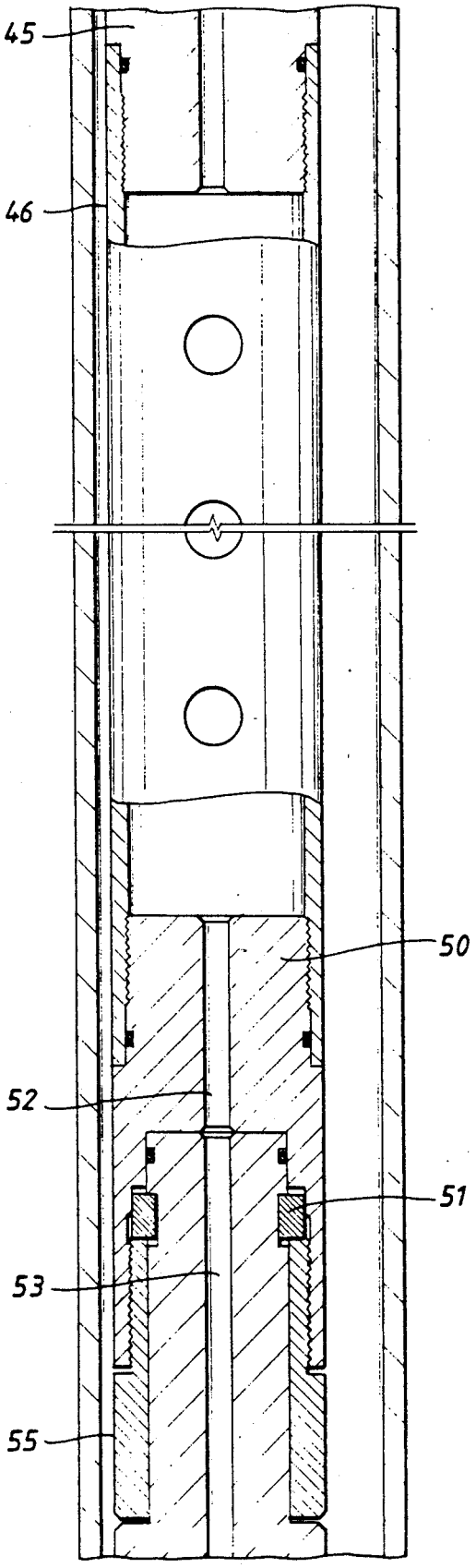
Figure 3D:
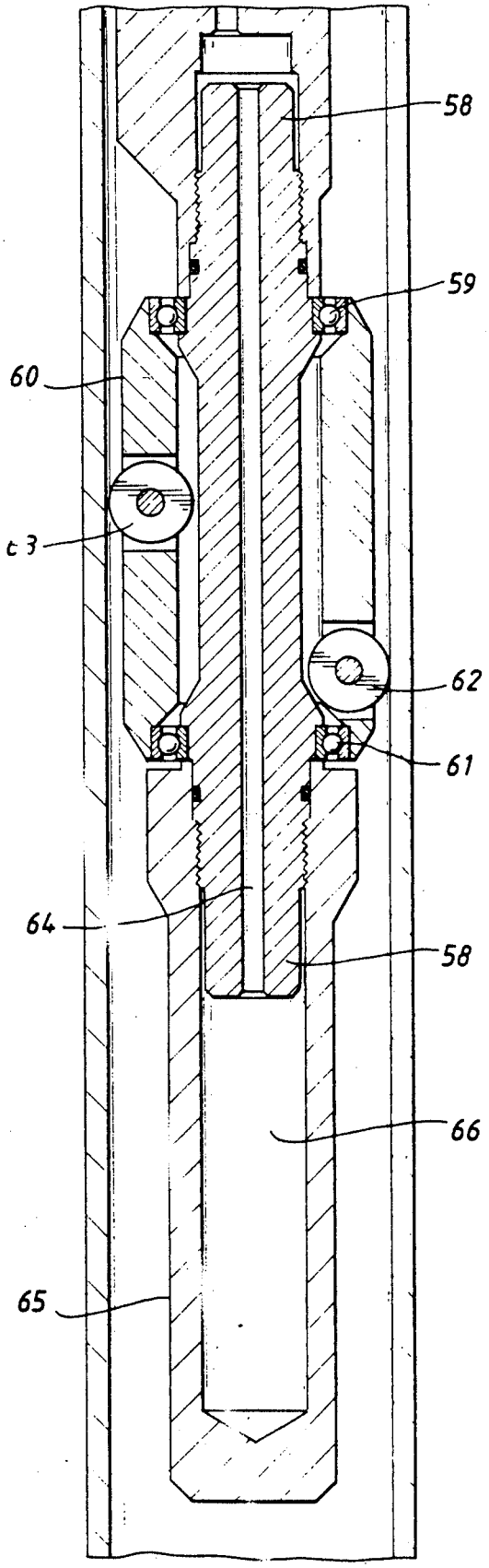

The circumstances in which the present procedure is carried out should be noted. The present procedure is a completion procedure. That is, the well has been drilled and it has been determined that there is sufficient interest in production that the well should be cased and the casing cemented in place. Moreover, it is normally known in advance what particular formation is the production zone, and information about the zone is obtained. This information includes the angle 15 which describes the angle of the formation bedding plane with respect to the horizontal reference, see FIG. 2. in other words, the angle 15 is known at this juncture. Typically, a survey of the well 10 is also run and this provides a map or chart of the path of the well. Thus, the slant or deviation angle of the well is also known in advance. It is generally known that the zone has a specified thickness also. With this information, the tool of the present disclosure is then used to form the perforations which will be described. Going now to FIG. 3 of the drawings, the tool of the present disclosure is shown in a cased well. The description will proceed from top to bottom. FIG. 3 is formed of several sequential sections which are illustrated in sequence to provide a full description of the apparatus.

The tool of the present disclosure is indicated generally by the numeral 20. It incorporates a cable head assembly for attachment to the wireline at 21. It is typically run in the well by connection with a wireline which connects at the cable head and suitable electrical connections are also included. These communicate through the wireline and connect to various components of the tool as will be described. The top end of the tool incorporates a swivel 22, typically a purchased item, which is in the preferred embodiment a pressure balanced wireline swivel which cancels torque from the wireline as it is reeled from the storage drum and extended in the well 10. In addition to that, the tool supports a navigation package 23 preferably containing a gravity operated pendulum connecting with a potentiometer which provides a signal for the surface. The signal indicates the angle of perforating shot plane of the tool with respect to the vertical. In addition to this, the tool includes a casing collar locator 24. The CCL detects the location of the casing collars to enable the perforating gun assembly 20 to be located at the correct depth in the well.

Continuing with the description of the perforating tool 20, an axial passage 25 is noted. This is an electrical pathway for conductors which extend through the tool from the very top to the bottom. One conductor extends to the very bottom of the perforating assembly 20 to operate a detonator mechanism which will be described. That is preferably carried at the lower end of the tool for reasons which will be set forth. Passage 25 extends through a sub 26, and the sub has an axial bore therethrough as mentioned which is countersunk to receive a mandrel 27. The mandrel 27 continues therebelow. The mandrel 27 is surrounded by a skirt 28 at the upper end, the skirt being appended to the sub 26 and formed integrally therewith. These two members are preferably threaded together and are joined when the tool is assembled. The skirt 28, however, terminates at the lower end and supports an abutting bearing assembly 29. The bearing assembly in turn supports a spaced sleeve 30. The sleeve 30 is supported by a similar bearing assembly 31 at the lower end. Both bearing assemblies are lock in place. They permit the sleeve 30 to rotate freely. The sleeve supports one or more rollers 32 for freewheeling motion on an axle 33. There is a window cut in the sleeve to enable the roller to extends outwardly. In the preferred embodiment, there are two sets of rollers supported by the sleeve at different elevations, and hence, they are shown offset along the length of the tool. Moreover, the rollers are duplicated. For instance, two sets of three or four rollers typically will suffice. The sleeve is able to rotate in either direction. The sleeve is rotatable, and thereby functions as a type of cradle assembly for the tool. As described to this juncture, the rollers contact the surrounding casing that makes up the well borehole. It is not essential that the rollers contact at all points around the circle which confines the tool within the casing. Rather, the maximum diameter of the tool measured at the rollers is something less so that the tool is able to traverse locations where the casing is not perfectly round. Moreover, the rollers 32 are sized so that they contact on what might be termed the bottom side of the tool. FIG. 3 shows the tool in a vertical posture, and this is the normal view one would have of the tool when it is first placed in the well. However, recall that FIG. 1 shows the well 10 to be deviated. At this point, the roller on the left is on the low side of the tool and tends to support the weight of the tool while the roller on the right is on the high side and typically does not contact the surrounding casing. This clearance enables the sleeve 30 to rotate left or right. It also enables the tool to slide down the cased well 10 supported on the wireline until it reaches the depth of the formation shown in FIG. 2.

The mandrel 27 threads into an eccentric sub 35. This has an offset enlargement 36 which is eccentrically mounted. The eccentric weight 36 extends along the length of the sub. It hangs to the low side when permitted to rotate. The sub 35 rotates with the mandrel 27. The mass of the eccentric 36 is sufficient to cause rotation. When rotation of the mandrel 27 occurs, it rotates within the sleeve 30 which is connected to it by the upper and lower bearing assemblies previously described. The eccentric 36 thus hangs to the low side. Again, recall that FIG. 3 shows the tool upright when in reality it is positioned at an angle so that the left side of FIG. 3 is the bottom side. The eccentric 36 is axially drilled with the passage 37 which terminates at a larger chamber 38 to enable wiring communication through the tool. The eccentric is a portion of the sub 35 and it is shaped with a circular external surface. A shoulder 39 limits upward movement of a hollow lock nut 40. The lock nut 40 is threaded for locking purposes. This will be detailed below.

The lock nut 40 has a lower peripheral edge 41 which abuts a lock ring 42. The ring 42 is received in an encircling groove 43 around the sub 35. Moreover, the sub 35 also abuts a shoulder 44 which is formed in an adjacent sub 45. The sub 45 has an upstanding internally threaded skirt 46. The lock nut 40 threads to the sub 45 at the threads on the skirt 46. Moreover, when the lock nut 40 is threaded to move upwardly, it disengages the lock ring 42. When the nut 40 is rotated in the opposite direction and is forced downwardly, it jams the lock ring 42 and forces the ring against the eccentric sub 35 so that the eccentric sub 35 is jammed against the sub 45 and held in fixed relationship on the shoulder 44. The subs 35 and 45 are thus locked together by the nut 40 when it is rotated to the down or locked position and they are free to relatively rotate when the lock nut 40 is in the up position.

The lock nut 40 is controllably installed to selectively fasten the subs 35 and 45 together so that they are prevented from relative rotation. Rotation is desirable so that the sub 45 can be rotated to a particular angle with respect to the eccentric 36. The purpose of this will be more apparent on description of the tool at the time of installing the shaped charges.

The sub 45 is threaded to an elongate perforating gun assembly 47. The gun 47 has an enclosure formed of an elongate sleeve which is an axially hollow sleeve which encloses one or more shaped charges pointing radially outwardly. The sleeve is provided with thin wall scallops 48 aligned with the shaped charges forming perforations at the circular scallops. The several shaped charges are supported by a common assembly aligned in the sleeve enclosure 47. This keeps all the debris after firing collected in the enclosing hollow sleeve 47. Preferably, rows of shaped charges are installed and they are aligned to fire in the same radial direction. There are rows of charges, one which can be seen in FIG. 3 and a duplicate or similar opposing set which form perforations 180° out of phase. In other words, perforations are made by the rows of shaped charges pointed in opposite directions. The sleeve has interior space to support the multiple shaped charges. As mentioned before, the passage 37 extends the connection pathway through the tool. The shaped charges are connected with a detonator mechanism located at the bottom of the perforating gun tool. The external sleeve, being axially hollow, is able to receive and support the necessary connections for rows of shaped charges. The preferred embodiment perferably includes two sets of shaped charges, the sets being positioned to form two opposing sets of perforations.

The housing connects with another sub 50 and is threaded to it in the same fashion as the sub 45 thereabove. The lock nut 40 is duplicated by the lock nut 55. This engages a similar ring 51 which causes the sub 50 to thread to and lock with a second eccentric sub 56. The passage 37 in the upper portion of the drawing is also extended at 52 through the sub 50 and again is extended at 53 through the eccentric sub 56. Since the lock nut 55 operates in the same fashion as the lock nut 40, it is believed that the foregoing description can likewise be applied to this lock nut so that it will be understood how the eccentric sub 56 is controllably locked to the elongate sleeve supporting the several shaped charges.

The eccentric sub 56 is drilled with an offset passage and supports a mandrel 58 which is similar in construction and purpose to the mandrel 27 previously mentioned. The mandrel 58 is threaded to the sub 56 thereabove. Thus, these two components move together as a unit. A bearing assembly 59 is shown therebelow and supports a surrounding sleeve 60 which is identical to the sleeve 30. It extends downwardly to another bearing assembly 61. In turn, this supports plural rollers 62 which are mounted on the appropriate axles 63. This enables a duplicate set of rollers to that shown at the top end of the tool to be positioned by the sleeve 60 for rotation. Moreover, the sleeve is able to rotate, thereby providing a mechanism whereby the sleeve operates as a cradle which permits the equipment passing through the center thereof to rotate. The upper sleeve 30 and the lower sleeve 60 are similar in construction and operation. The lower end of the mandrel 58 is threaded to an enclosed sub 65 having a chamber 66 for enclosing the detonation equipment. The mandrel 58 thereabove is provided with the axial passage 64 which extends through it and connects with the chamber 66. A conductor for firing is extended along the several passages shown in FIG. 3 and is received in the chamber 66 where it connects with the detonation equipment. In turn, the passage also received the conductors extending from the detonator back to the charges for operation of the charges.

Various and sundry seals are included to prevent leakage of any fluid in the well into the tool. Thus, the axial passage along the tool is sealed so that the firing equipment is not subjected to the intrusion of well fluid or elevated pressures.

The foregoing describes the structure of the present apparatus. However, the operation should be noted. This operation can be given best by an example. For this purpose, assume that the well 10 has a region which is a slant well which is inclined at a 45° angle with respect to the vertical. Assume further, that the fracture bedding plane shown in FIG. 2 of the drawings is at an angle of 30° with respcet to the horizon. This means that the perforations on one side of the perforating gun assembly should be directed at an angle of 60° with respect to the vertical and the opposite set of perforations should be 180° out of phase because they are located on the opposite side of the perforating gun assembly. This is an angle of 30° which is implemented at the surface. It is implemented by first installing the sub 45 onto the sleeve 47 which houses the shaped charges within the sleeve behind the scallops 48. After installation, and with the lock nut 40 loose, the eccentric 36 is moved relative to the axis of the sleeve housing the shaped charges. As shown in FIG. 3, the perforating gun will form perforations which are perpendicular to the plane of the paper. The lock nut 40 is loosened, the threaded skirt 46 is rotated so that all the perforating guns supported by the tool are aligned in the new position relative to the eccentric 36. After that alignment has been accomplished, the lock nut 40 is then tightened by threaded engagement. This acts against the ring 42 and accomplishes tightening. The same activity is repeated at the lower end of the tool so the lock nut 55 is likewise fastened. When the two lock nuts are threaded up tight, the eccentric weights 36 and 56 hang to the side at a common azimuth with respect to the shaped charges supported by the sleeve 47. Between the two eccentric subs, the sleeve 47 and enclosed shaped charges are mounted eccentrically. The sleeve can be as short or long as needed; it is not uncommon for the sleeve to be twenty feet long. In a longer length, the greater portion of tool weight is eccentered. For instance, in a 500 pound tool (with guns), as much as seventy-five or eighty percent of the weight is eccentric. The navigation package is turned on and its relative position to the eccentric weight is recorded.

The tool is then lowered into the well borehole. The CCL counts the casing collars as the tool travels downwardly. The tool travels rather smoothly because it is equipped with rollers, upper and lower rollers in particular, which enable it to travel smoothly. As it passes through the various casing collars, the depth of the tool in the well is determined. When it reaches the requisite depth based on casing collar count in conjunction with the schedule of pipe lengths involved in the casing string, the cable is held so that the tool can no longer travel. At this juncture, the navigation equipment forms an output signal which is indicative of the shaped charges phase orientation with respect to the vertical. Referring to FIG. 2, this equipment measures the angle of the perforating gun assembly with respect to the vertical reference 12. If this angle coincides with the angle which was thought to be correct, then the equipment has been determined to be at the right depth in the well and at the right angle of phase orientation. Time is permitted to pass so that the tool can rotate. Tool rotation involves the rotor carriages at the upper and lower ends of the tool. Recall the sleeves 30 and 60 which support the sets of rollers. The rollers on the two sleeves contact the casing which defines the well borehole, and permit the tool to rotate along its lengthwise axis. This rotation is driven by the eccentrics which extend to a common azimuth. Here, it must be noted that the eccentrics are pointed in a particular direction when the tool is first places in the well borehole. At the surface, however, the tool is vertical and the eccentrics are not free to fall to the gravity side or down side. As the well deviates from the vertical, and especially when it reaches a deviation of forty, fifty or even seventy degrees, the eccentrics fall to the low side of the well. This causes rotation of the entire tool. Rotation is not resisted by the cable which is connected to the tool because the tool includes the swivel mechanism 22 at the upper end and that permits the tool to rotate in either direction without bias and further permits it to rotate sufficiently that the eccentrics fall to the down or bottom side. The two eccentrics and perforating gun 47 thus moce to the down side and define the vertical line 12 shown in FIG. 2. When that occurs, the shaped charges within the sleeve are then correctly positioned.

Recall from surface assembly that the sleeve has been rotated with respect to the eccentrics. It is thus positioned so that the perforations 17 shown in FIG. 2 are formed as close as possible parallel to the formation bedding plane. This enables the perforations to have greater length and to extend deeper into the formation of interest, and to provide the resultant production. At this juncture, the tool can then be fired. The sequence therefore has the first step of determining that the tool is at the right well depth, then measuring the angle of orientation of the tool which measurement is compared bymeans of the navigation package with the anticipated orientation. If a match is obtained, this indicates the tool is at the right well depth and orientation with respect to the vertical reference. Time is permitted for the tool to rotate inside the roller mounted cradles at the upper and lower ends of the tool. If desired, while monitoring the navigation package data and recording at the surface the tool can be raised and lowered gently a few times, moving only a few feet on each stroke, all for the purpose of permitting rotation. Rotation is accomplished so that the perforating guns are then correctly referenced to the vertical lines in FIGS. 1 and 2. This then positions the perforating guns for operation. A signal from the surface is transmitted down the wireline. It travels through conductors in the several passages through the tool to the chamber 66 at the lower end. The detonation equipment is located in that chamber, and in turn, that forms a signal producing detonation. That signal is conveyed to the various perforating charges and they are fired by that siganl. After firing, the tool is retrieved on the wireline. It travels easily out of the well borehole because it is traveling in the slant well supported on rollers. When it is in the vertical path of the well, contact with the casing is somewhat incidental. It can be retrieved quickly and at the surface, the sleeve and spent shaped charges in the sleeve is discarded and a gun assembly 47 is installed. If needed, the relative angle of the shaped charge (when they are fired) is adjusted by adjustment of the angular position of the threaded skirt 46 with respect to the eccentrics. In summary, the device can be readjusted so that each use of the device can move to a different angular direction.

While the foregoing is directed to the preferred embodiment, the scope thereof is determined by the claims which follow.

What is claimed is:

1. An apparatus for orienting a perforating gun in a well borehole, comprising:

an elongated tool body having upper and lower ends and defining an axis of rotation:

at least two spaced apart, circumferential cylindrical sleeves enclosing said tool body and having bearing means to enable said tool body to rotate internally relative to said sleeves;

eccentered weight means positioned between said sleeves and located eccentrically relative to the axis of rotation;

an elongated perforating gun carrier sleeve supporting a plurality of shaped charges, positioned between said circumferential cylindrical sleeves and releasably connected to said eccentered weight means for rotational movement therewith; and means for releasably locking said elongated perforating gun carrier sleeve to said eccentered weight means such that the shaped charges supported by said perforating gun carrier sleeve can be locked at a predetermined angular position relative to the eccentrically located weight of the eccentered weight means.

2. The apparatus of claim 1 wherein said circumferential cylindrical sleeves include roller means having axes of rotation at right angles to said tool body axis of rotation mounted thereon for contact with the well borehole's wall.

3. The apparatus of claim 2 wherein said roller means include free wheeling rollers distributed circumferentially around said tool body.

4. The apparatus of claim 3 wherein a plurality of said circumferential cylindrical sleeves are located spaced along said tool body to support said tool body in a slant well borehole.

5. The apparatus of claim 1 wherein said releasable locking means comprise a threadable lock nut advancing against a shoulder to lock said elongated perforation gun carrier sleeve relative to said tool body.

6. The apparatus of claim 5 wherein said threadable lock nut is movable to a release position allowing relative rotational movement between said perforating gun carrier sleeve and tool body.

* * * * *